US011676785B2

(12) United States Patent
Mladenovic et al.

(10) Patent No.: US 11,676,785 B2
(45) Date of Patent: Jun. 13, 2023

(54) GAS-INSULATED SWITCH

(71) Applicant: SIEMENS ENERGY GLOBAL GMBH & CO. KG, Munich (DE)

(72) Inventors: Ivana Mladenovic, Seukendorf (DE); Paul Gregor Nikolic, Erlangen (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/259,653

(22) PCT Filed: Jul. 8, 2019

(86) PCT No.: PCT/EP2019/068211
§ 371 (c)(1),
(2) Date: Jan. 12, 2021

(87) PCT Pub. No.: WO2020/011695
PCT Pub. Date: Jan. 16, 2020

(65) Prior Publication Data

US 2021/0319966 A1 Oct. 14, 2021

(30) Foreign Application Priority Data

Jul. 12, 2018 (DE) ..... 102018211621.0

(51) Int. Cl.
*H01H 33/70* (2006.01)
*H01H 33/90* (2006.01)
*H01H 33/91* (2006.01)

(52) U.S. Cl.
CPC ..... *H01H 33/91* (2013.01); *H01H 33/7023* (2013.01); *H01H 33/901* (2013.01); *H01H 33/905* (2013.01)

(58) Field of Classification Search
CPC ..... H01H 33/7023; H01H 33/7038; H01H 33/56; H01H 33/901; H01H 33/905;
(Continued)

(56) References Cited

U.S. PATENT DOCUMENTS 4,434,332 A * 2/1984 Yanabu ..... H01H 33/143 218/144
4,445,020 A 4/1984 Ueda et al.
(Continued)

FOREIGN PATENT DOCUMENTS

CH 607658 A5 9/1978
DE 102011005905 A1 9/2012
(Continued)

OTHER PUBLICATIONS

Translation of EP1079404 (Original doc. published Feb. 28, 2001) (Year: 2001).*
(Continued)

*Primary Examiner* — William A Bolton
(74) *Attorney, Agent, or Firm* — Laurence A. Greenberg; Werner H. Stemer; Ralph E. Locher

(57) ABSTRACT

A gas-insulated switch has a first contact and a second contact. A contact unit is connected to the first contact as a movement contact unit having a drive unit and is movably mounted along a switch axis. The gas-insulated switch further has a multi-part insulation nozzle system with a primary nozzle and an auxiliary nozzle. A heating channel is formed between the primary nozzle and the auxiliary nozzle. The heating channel originates from an electric arc chamber and opens in a gas reservoir, wherein the gas reservoir is delimited by a ram. The gas reservoir is radially delimited by a wall, in respect of the switch axis, which is not a component of the movement contact unit, and the ram is part of the movement contact unit and is movably mounted such that the ram moves along the switch axis away from the second contact to enlarge the gas reservoir.

8 Claims, 2 Drawing Sheets

(58) Field of Classification Search
CPC ..... H01H 33/91; H01H 33/7076; H01H 33/7084; H01H 33/7092; H01H 33/74; H01H 33/78
USPC .. 218/62, 46, 53, 57, 59, 60–61, 63, 72, 93, 218/97, 116, 3, 4, 43
See application file for complete search history.

(56) References Cited

U.S. PATENT DOCUMENTS 4,458,119 A * 7/1984 Hashimoto ..... H01H 33/143 218/3
4,486,632 A 12/1984 Niemeyer et al.
5,739,495 A * 4/1998 Marin ..... H01H 33/7061 218/62
5,898,149 A 4/1999 Berger et al.
6,207,917 B1 * 3/2001 Lehmann ..... H01H 33/88 218/154
6,624,371 B2 * 9/2003 Dufournet ..... H01H 33/901 218/59
6,744,000 B1 * 6/2004 Bergmann ..... H01H 33/24 218/43
9,029,726 B2 * 5/2015 Cernat ..... H01H 33/91 218/43
9,240,680 B2 1/2016 Hartmann et al.

FOREIGN PATENT DOCUMENTS

EP 0067460 A1 12/1982
EP 0741399 A1 11/1996
EP 0766278 A2 4/1997
EP 1079404 A2 2/2001
EP 1548780 A1 6/2005
KR 20150000664 * 1/2015 ..... H01H 33/90

OTHER PUBLICATIONS

Translation of KR20150000664 (Original document published Jan. 5, 2015) (Year: 2015).*

* cited by examiner

GAS-INSULATED SWITCH

BACKGROUND OF THE INVENTION

Field of the Invention

The invention relates to a gas-insulated switch as specified in the independent gas-insulated switch claim and a high voltage switching arrangement as specified in the independent high voltage switching arrangement claim.

In the area of high and medium voltage switchgears sulfur hexafluoride $SF_6$ is currently used as an insulating gas and an extinguishing gas. This gas is excellently suited for the applications mentioned, but its disadvantage is that it has a very high greenhouse potential. The alternative currently being discussed in this respect consists in various compounds as insulating media, in particular fluorinated compounds. On the other hand it is also convenient to integrate vacuum switching tubes in power switches. However an increase in rated voltage leads to a disproportionate increase in technical expenditure, which is necessary for providing vacuum switching tubes in order to ensure sufficient voltage stability of the switching path after a power failure. In order to reduce this expenditure it might be convenient to provide a circuit breaker designed in particular in the form of a gas-insulated switch, which can be opened under electrical load, i.e. in particular in case of a short-circuit, and which dielectrically discharges the vacuum switching tube.

SUMMARY OF THE INVENTION

It is an objective of the invention to provide a circuit breaker in form of a gas-insulated switch, which compared to conventional gas-insulated switches has a higher opening speed of the contacts in case of a short-circuit. Further the objective consists in providing a high voltage switching arrangement with a vacuum switching tube, which compared to the state of the art is able to carry a higher voltage per installation space.

The solution to the objective consists in a gas-insulated switch as specified in the independent gas-insulated switch patent claim and a high voltage switching arrangement as specified in the independent high voltage switching arrangement patent claim.

The gas-insulated switch has a first contact and a second contact each of which are a component of a contact unit. At least one contact unit is connected to the first contact as a movement contact unit having a drive unit. The movement contact unit is movably mounted along a switch axis. Further the gas-insulated switch includes a multi-part insulation nozzle system, which has a primary nozzle and an auxiliary nozzle, wherein a heating channel is formed between the primary nozzle and the auxiliary nozzle, said heating channel originating from an electric arc chamber and opening in a gas reservoir. This gas reservoir is delimited on one side by a ram. The invention is characterized in that the gas reservoir in respect of the switch axis is radially delimited by a wall, as least in part, wherein the movement contact unit, in respect of this wall, is movably mounted along the switch axis and in that the ram is part of the movement contact unit and together with the same is movably mounted in respect of the second contact such that the ram during an opening process of the two contact units for enlarging the gas reservoir moves along the switch axis away from the second contact.

As regards its construction the gas-insulated switch of the invention is similar to a so-called self-blowing switch, but it is different in that the conventional self-blowing switch has a self-blowing volume which is reduced in its volume during opening of the two contact systems by a ram such that an extinguishing gas is pressed back through the heating channel into the electric arc chamber, thereby extinguishing the electric arc. In this conventional self-blowing switch of the state of the art, the wall, which radially delimits the self-blowing volume, is however part of the movement contact system and remains unmoved during opening of the switch in respect of the self-blowing volume/the gas reservoir. In the present invention the wall is movably mounted in respect of the first contact unit and as such is not a component of this first contact unit. In the present invention the gas reservoir enlarging during the opening process moves along the described wall of the reservoir.

It remains to be noted that the insulation nozzle system represents a functionally interacting system in that the individual components, taken on their own, may each be part of the contact units. That means that the components, i.e. the primary nozzle and the auxiliary nozzle, do not have to be rigidly arranged in relation to each other, but can move towards and away from each other during the opening and closing processes.

Due to the movable mounting of the contact of the movement contact unit, normally a tulip contact, and the auxiliary nozzle surrounding it in the switching chamber, the invention makes it possible, in contrast to the self-blowing power switches used nowadays, to enlarge the gas reservoir, which in the present invention does not serve as a self-blowing volume. Rather due to the hot gas flowing in through the heating channel a force is exerted upon the ram, which causes an acceleration of the movement contact system in pulling direction of the drive thereby supporting the drive movement/increasing the drive speed. This makes it possible for the same drive energy to effect an increase in the contact opening speed or for a constant contact opening speed to effect a reduction in drive energy.

In a further embodiment of the invention the wall delimiting the gas reservoir, at least in part, is a component of the contact unit of the second contact. This means that parts of the second contact system, i.e. at least the described wall, preferably radially surround parts of the first contact system and contribute to form a cavity, namely the gas reservoir, which is being enlarged during opening of the switch caused by the flowing-in hot gas. Conveniently said wall is constructively fixed to the second contact system, which is realizable at little expense. In principle it may also be convenient to fix the wall to the housing of the vacuum switching tube.

In a further embodiment of the invention the ram is arranged in the first contact system such that it is designed substantially vertically in respect of a switch axis. In essence this means that an angular position relative to the switch axis is no more than 15°.

With this arrangement the ram is rotation-symmetrically designed in respect of the switch axis. This leads to a rotation-symmetric, substantially cylinder-wall-shaped gas reservoir around the switching contact. In an advantageous embodiment the ram is attached to a mounting of the auxiliary nozzle and firmly fixed to the movement contact system.

With a gas-insulated switch constructed according to the self-blowing principle the two contacts have different shapes, one contact is a tulip contact, which is preferably the first contact, and the other is a pin contact which is preferably designed as a second contact. The pin contact is preferably part of a fixed contact unit. The tulip contact is preferably part of the movement contact unit, wherein in principle both contact units may also be movably designed via an appropriate coupled drive.

In a further embodiment of the invention the described wall of the gas reservoir is part of the primary nozzle. This would facilitate a low-cost constructional conversion.

A further embodiment of the invention is a high voltage switching arrangement which encompasses a gas-insulated switch as well as a vacuum switching tube. The gas-insulated switch and the vacuum switching tube, which again may be a component of a power switch, are connected in series. Due to the fact that the described gas-insulated switch can be switched under load, the series-connected vacuum switching tube will function at a lower electrical strength in respect of the rated voltage. This requires less technical expenditure during construction of the vacuum switching tube, and it is possible in principle to achieve higher rated voltages by using a specified type of construction.

It may be convenient for the gas-insulated switch and the vacuum switching tube/a power switch in which the vacuum switching tube is integrated to be operated by a joint drive. This facilitates a simple technical construction and, on the other hand, a secure time sequence of the switching processes.

In a further embodiment of the invention the high voltage switching arrangement is configured such that the voltage division across the gas-insulated switch and the vacuum switching tube is controlled by a control device. A control device may for example be a capacitor or a resistance or a coupling of a capacitor and a resistance.

Further embodiments and further characteristics of the invention will be described in more detail by way of the drawings below. Characteristics in different designs but with identical labelling are provided with the same reference symbols. In principle these are schematic embodiments which are of a purely exemplary nature and do not represent a restriction of the scope of protection.

DETAILED DESCRIPTION OF THE INVENTION

Figure 1:
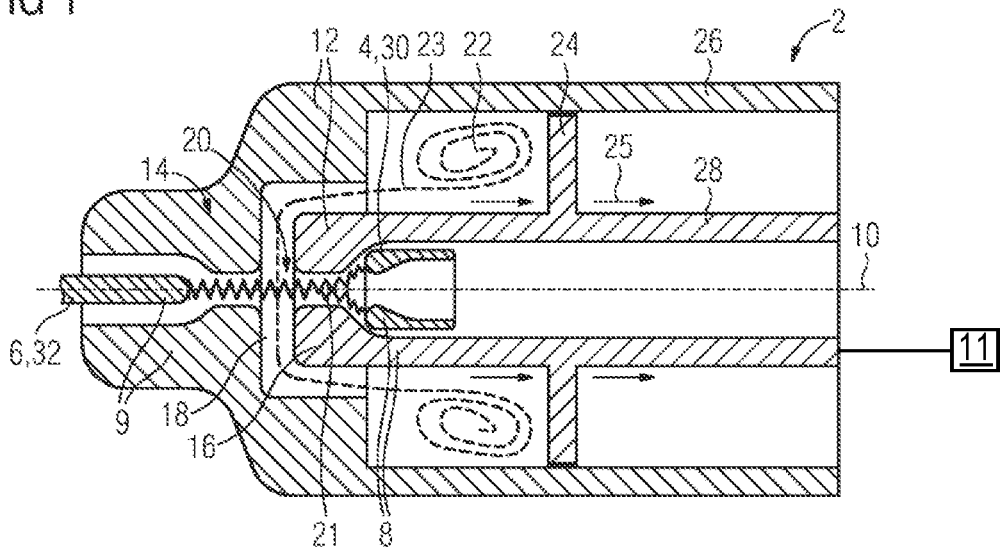
FIG. 1 shows a cross-section through a gas-insulated switch having a movement contact unit and a fixed contact unit as well as a gas reservoir.

FIG. 1 shows a cross-section through a gas-insulated switch, which has a first contact 4, which is designed in form of a tulip contact 30, and which has a second contact 6, which is designed in form of a pin contact 32. Both contacts 30, 32 are integrated, respectively, into a contact unit 8, 9, a first contact unit 8 and a second contact unit 9. The two contacts 30 and 32, during an opening process or closing process of the gas-insulated switch 2, are mounted along a switch axis 10 so as to be translationally movable relative to each other. As a rule, it is not mandatory for the pin contact 32 to be designed as a fixed contact, the tulip contact 30, however, is designed as a moving contact. Thus the first contact unit 8 with the tulip contact 30 could also be called a movement contact unit.

Further the gas-insulated switch 2 has an insulation nozzle system 12, which in particular comprises a primary nozzle 14 and an auxiliary nozzle 16 as well as a heating channel 18 formed thereby. The heating channel 18 extends from an electric arc chamber 20 to a gas reservoir 22. The electric arc chamber 20 is the chamber, which forms during opening of the contacts 30, 32 and in which a switching arc 21 occurs during the opening process.

Here the gas reservoir 22 is delimited, on the one hand, by the auxiliary nozzle 16 on a radial inside in this embodiment and radially by a wall 26 from the switch axis 10 towards the outside. These two delimitations by the auxiliary nozzle 16 and the wall 26 extend radially circumferentially, but parallel to the switch axis 10. Furthermore a ram 24 is provided, which axially delimits the gas reservoir 22. This means that the ram 24 extends substantially vertically, but rotation-symmetrically to the switch axis 10 and is movably mounted at least in respect of the wall 26. This means that the ram 24 is a fixed component of the movement contact unit 8, whereas the wall 26 is not part of this movement contact unit 8. In a preferred embodiment depicted in FIG. 1 the wall 26 may be a component of the second contact unit 9, it may be realized as an extension of the main insulating nozzle 14. But the wall 26 may also be mechanically decoupled from the fixed contact unit 9 and for example (not depicted) arranged on the housing of the switch 2.

During an opening movement of the switch 2 the tulip contact 30 and the pin contact 32, driven by a drive device 11, move along the switch axis 10 away from each other. During opening of the contacts 30, 32 a switching arc 21 is created. Due to the switching arc 21 the insulating medium, substantially in gas form, present in the electric arc chamber is heated and pressed via the heating channel 18 into the gas reservoir 22. The movement of the gas along the heating channel 18 occurs, in particular, due to the rise in temperature and the resulting volume expansion. This volume expansion in turn leads to the insulating medium 23 being pressed against the ram 24 at such a high energy that the translational movement of the first contact unit 8, which essentially comprises the tulip contact 30, the auxiliary nozzle 16 and the ram 24, takes place so quickly that the speed of the movement caused by the drive is exceeded. This is therefore an additional acceleration of the movement contact unit 8 away from the fixed contact 32. As a result the gas reservoir 22 is enlarged and the ram 24 moves in direction of the arrow 25.

Figure 4:
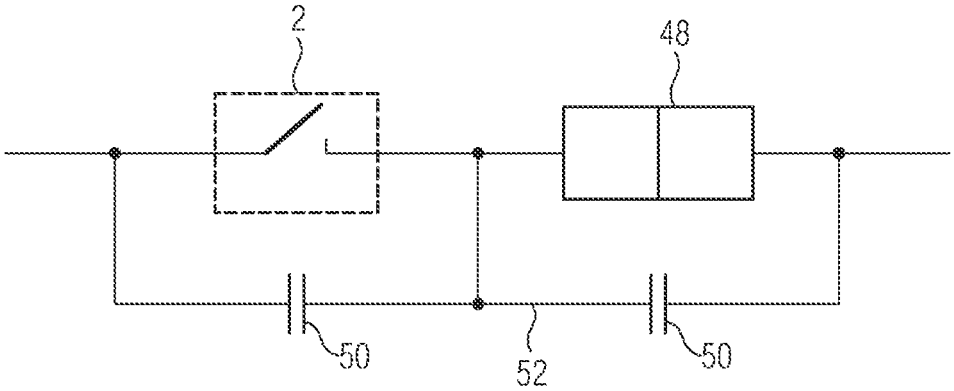
FIG. 4 shows a series connection of the described gas-insulated switch having a vacuum switching tube and control devices connected in parallel thereto.

Thus, with the described opening mechanism of switch 2, the energy of the electric arc 21 is utilized in order to speed up the opening of the switch 2 and thereby also increase the separating distance between the two contacts 30, 32. In this way the electric arc 21 is also extinguished. This may be relevant in particular then, when the switch 2 is connected in series with a vacuum switching tube 48, as depicted in FIG. 4. This series connection will be discussed in more detail further below.

Figure 2:
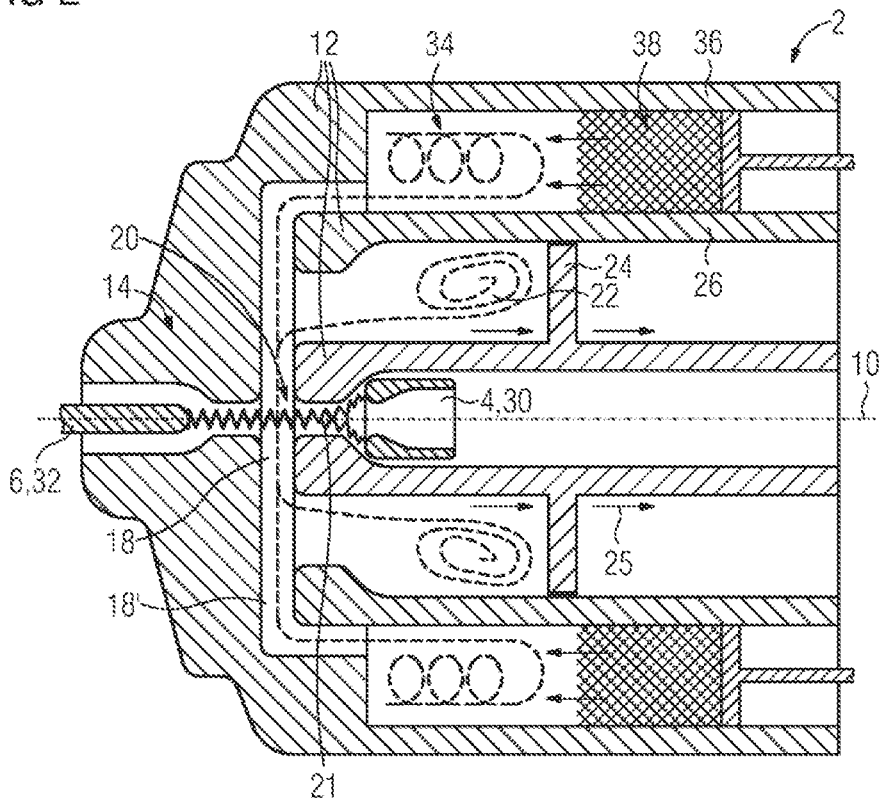
FIG. 2 shows a gas-insulated switch analogously to FIG. 1 with an additional electric arc extinguishing volume.

With the arrangement described in FIG. 1 a self-blowing volume known as a self-blowing switch for extinguishing the switching arc 21 is omitted. The total electric arc energy is thus spent on speeding up the opening of the contact units 8, 9. But it may also be convenient for the energy from the electric arc to be divided and to be used, on the one hand, for a speeded-up opening of the switch 2/the contact units 8 and 9 and for another part of the electric arc energy to be directed analogously to the self-blowing switch into an electric arc extinguishing volume 34, wherein again, analogously to the known self-blowing switch, a compression volume 38 is also present, which opens at a certain counter-pressure and raises the pressure in the electric arc extinguishing volume 34, thereby initiating a return flow of the heated insulating medium 23 through a branched-off heating channel 18' into the electric arc chamber 20 and resulting in an extinction of the switching arc 21. This is depicted in FIG. 2 insofar as the device in FIG. 1 additionally comprises a second wall 36 aligned radially in respect of the switch axis 10, wherein said wall is a component of the second contact unit 9, which again at least partially radially surrounds the gas reservoir 22 and the first contact unit 8. With this embodiment it is possible that on the one hand the speed of the opening movement for the same amount of drive energy is increased and in parallel thereto a further part of the energy of the switching arc 21 is utilized for electric arc extinction.

Figure 3:
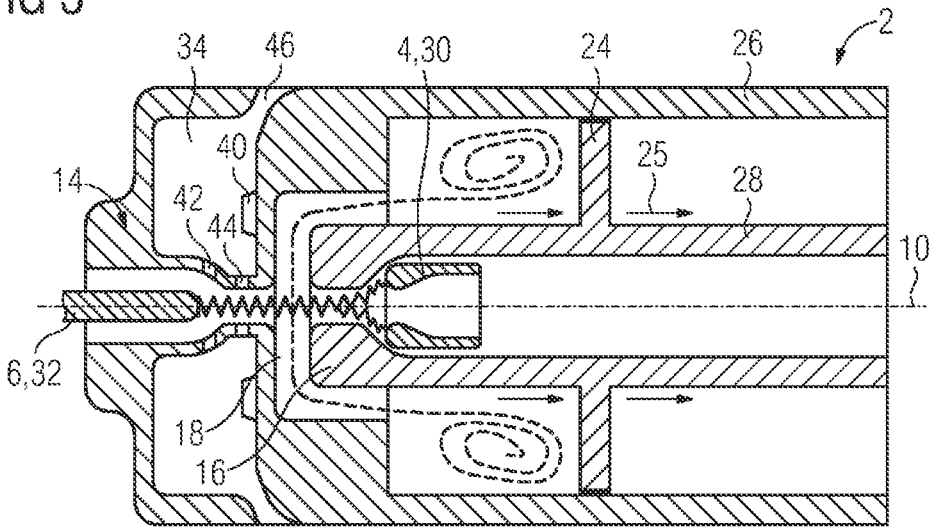
FIG. 3 shows a gas-insulated switch analogously to FIG. 1 with an electric arc extinguishing volume in the primary insulation nozzle.

In FIG. 3 an alternative embodiment of the advantageous representation as in FIG. 2 is depicted, which again reverts back to the switch 2 as in FIG. 1, but which is constructed such that the electric arc extinguishing volume 34 is installed in the primary nozzle 14, wherein here flow control is constructively ensured, as required, by way of a hot gas channel 44 and a cold gas channel 42 as well as an appropriate arrangement of flow control elements 40. Furthermore a compression volume 38 not shown may again be provided here, via which insulation medium 23 may be additionally pressed via a respective compression channel 46 into the electric arc extinguishing volume 34.

In FIG. 4 a power switch 52 is depicted, which comprises a gas-insulated switch 2 and a vacuum switching tube 48. Parts of the power switch 52 are one or two control devices 50, which are connected in parallel with the respective switching units, the gas-insulated switch 2 and the vacuum switching tube 48. The control device 50 is for example a series connection or a parallel connection between a capacitor and a resistance or merely a resistance. This arrangement has the effect that for example a vacuum switching tube 48, which is designed for a rated voltage level of 145 kV or 245 kV, can be employed in conjunction with the gas-insulated switch 2 switchable under load, also a circuit breaker at rated levels higher by several hundred kilovolt than the nominally provided voltage levels. In this way the technical expenditure for manufacturing the vacuum switching tube 48 is distinctly reduced, which leads to smaller installation spaces and lower manufacturing costs. An important prerequisite for achieving this is the described gas-insulated switch 2, which is based on the technology of a commonly used self-blowing switch, but which is modified in respect of this switch in such a way that it can be opened under load, in particular also in case of a short-circuit, and results in a rapid dielectric reconsolidation.

LIST OF REFERENCE SYMBOLS

2 gas-insulated switch
4 first contact
6 second contact
8 contact unit first contact
9 contact unit second contact
10 switch axis
12 insulation nozzle system
14 primary nozzle
16 auxiliary nozzle
18 heating channel
20 electric arc chamber
21 switching arc
22 gas reservoir
23 insulating medium
24 ram
25 movement direction of ram
26 wall
28 mounting
30 tulip contact
32 pin contact
34 electric arc extinguishing volume
36 second wall
38 compression volume
40 flow control element
42 cold gas channel
44 hot gas channel
46 compression channel
48 vacuum switching tube
50 control device
52 power switch

The invention claimed is:

1. A gas-insulated switch, comprising:

a first contact unit having a first contact and second contact unit having a second contact;

said first contact and said first contact unit being a movement contact unit connected to a drive unit and is movably mounted along a switch axis;

a gas reservoir;

a ram, said gas reservoir being delimited on one side by said ram;

a multipart insulation nozzle system having a primary nozzle, an auxiliary nozzle, and an electric arc chamber, said primary nozzle and said auxiliary nozzle defining a heating channel formed between said primary nozzle and said auxiliary nozzle, said heating channel originating from said electric arc chamber and opening in said gas reservoir;

said auxiliary nozzle having a mounting and said ram being attached to said mounting of said auxiliary nozzle; and a wall, said gas reservoir being radially delimited by said wall, at least in part, in respect of the switch axis, wherein said movement contact unit in respect of said wall is movably mounted along the switch axis and in that said ram is part of said movement contact unit and is movably mounted together with said movement contact unit in respect of said second contact in such a way that said ram during an opening process of said first and second contact units moves along the switch axis away from said second contact in order to enlarge said gas reservoir.

2. The gas-insulated switch according to claim 1, wherein said wall delimiting, at least partially, said gas reservoir is a constituent part of said second contact unit.

3. The gas-insulated switch according to claim 1, wherein said ram is aligned substantially vertically in respect of the switch axis.

4. The gas-insulated switch according to claim 1, wherein said ram, in respect of the switch axis, is configured rotation-symmetrically.

5. The gas-insulated switch according to claim 1, wherein said first contact is a tulip contact and said second contact is a pin contact.

6. The gas-insulated switch according to claim 1, wherein said wall is part of said primary nozzle.

7. A high voltage switching configuration, comprising:

a gas-insulated switch, containing:

a first contact unit having a first contact and second contact unit having a second contact;

said first contact and said first contact unit being a movement contact unit connected to a drive unit and is movably mounted along a switch axis;

a gas reservoir;

a ram, said gas reservoir being delimited on one side by said ram;

a multipart insulation nozzle system having a primary nozzle, an auxiliary nozzle, and an electric arc chamber, said primary nozzle and said auxiliary nozzle defining a heating channel formed between said primary nozzle and said auxiliary nozzle, said heating channel originating from said electric arc chamber and opening in said gas reservoir;

said auxiliary nozzle having a mounting and said ram being attached to said mounting of said auxiliary nozzle; and a wall, said gas reservoir being radially delimited by said wall, at least in part, in respect of the switch axis, wherein said movement contact unit in respect of said wall is movably mounted along the switch axis and in that said ram is part of said movement contact unit and is movably mounted together with said movement contact unit in respect of said second contact in such a way that said ram during an opening process of said first and second contact units moves along the switch axis away from said second contact in order to enlarge said gas reservoir; and at least one vacuum switching tube, wherein said gas-insulated switch and said vacuum switching tube are connected in series.

8. The high voltage switching configuration according to claim 7, further comprising a control device for dividing a voltage between said gas-insulated switch and said vacuum switching tube.

* * * * *